United States Patent [19]

Courtan

[11] 4,079,289

[45] Mar. 14, 1978

[54] STORAGE TUBE FOR THE STORAGE OF DIGITAL INFORMATION

[75] Inventor: Bernard Courtan, Paris, France

[73] Assignee: Thomson-CSF, Paris, France

[21] Appl. No.: 754,235

[22] Filed: Dec. 27, 1976

[30] Foreign Application Priority Data

Dec. 31, 1975 France ..... 75 40297

[51] Int. Cl.[2] ..... H01J 31/60

[52] U.S. Cl. ..... 315/8.5; 313/391; 365/118

[58] Field of Search ..... 315/85; 313/391, 394, 313/461; 340/173 CR, 324 A, 347 AD, 366 CA

[56] References Cited

U.S. PATENT DOCUMENTS

| | | | |
|---|---|---|---|
| 2,844,722 | 7/1958 | Hines | 315/8.5 X |
| 2,871,398 | 1/1959 | Chrvney | 315/8.5 |
| 3,046,440 | 7/1962 | Callick et al. | 315/8.5 |
| 3,778,658 | 12/1973 | Harris | 313/391 |

OTHER PUBLICATIONS

*Deformographic Storage Display Tube Target*, Davis, IBM Technical Disclosure Bulletin, vol. 17, No. 9, Feb. 1975, pp. 2738–2742.

*Primary Examiner*—Eugene R. La Roche
*Attorney, Agent, or Firm*—Roland Plottel

[57] ABSTRACT

A storage tube which makes it possible to record and read-out digital messages with good addressing accuracy comprises a storage target on which recording tracks are formed, along which the recording and thereafter the read-out electron beam are displaced. Appropriate biasing of the conductive bands separating the tracks makes it possible to achieve good addressing accuracy.

9 Claims, 8 Drawing Figures

STORAGE TUBE FOR THE STORAGE OF DIGITAL INFORMATION

The present invention relates to a storage tube which makes it possible to record and read out digital information, for example binary information, with an appropriate addressing accuracy, said tube at the same time having a very high information storage capacity.

Storage tubes have hitherto conventionally been used to store analogue information, said informations being stored and read out sequentially, one image element after another, without it being necessary to know which element is being recorded or read out, that is to say without any need to be able to "address" the elements.

The use of such tubes for storing digital informations and for example sequences of binary information, would be highly desirable in view of the large information storage capacity they could have. However, such an operating mode has never been comtemplated due to the fact that it is impossible to achieve sufficiently accurate adressing using conventional methods of recording and read-out of these tubes.

The present invention relates to a storage tube which, thanks to a novel and original kind of structure, makes it possible to effect both recording and read-out of digital information, by a method which guarantees an appropriate level of addressing accuracy.

A storage tube according to the invention, for the storage of sequences of digital information, comprises an electron-gun, a storage target and means for deflecting the electron beam emitted by said electron-gun towards said target so that its impact area scans said target, the improvement consisting in the following characteristics:

said storage target is made of dielectric bands on a conductive plate, said dielectric bands being partly covered by conductive bands narrower than said dielectric bands;

said electron-gun emits a beam which is so thick in at least one direction of its cross-section, namely that direction perpendicular to said dielectric bands of said target, that it emits electrons simultaneously towards a plurality of neighbouring dielectric bands;

biasing means are provided for biasing said conductive bands so that said bands are biased, as when recording informations as well as when reading them out, in such a way that the electrons emitted by said electron-gun towards a plurality of neighbouring dielectric bands only strike one zone between two conductive bands of said plurality, each such zone between two neighbouring conductive bands being called a track.

Such a tube makes it possible, even if the deflection means used are not entirely perfect, to cause the recording beam and subsequently the read-out beam, to follow one and the same single track which is selected by appropriate biasing of the surrounding conductive bands; it makes it possible, therefore, to eliminate any positional error perpendicularly to said tracks, and thus to record and subsequently read out the information sequentially along each track.

A better understanding of the invention will be had from the ensuing description with reference to the accompanying drawings, wherein.

A complete description of conventional storage tubes and of their modes will not be given in a detailed fashion; we will only summarize the matter necessary for a proper understanding of the novel tubes of the invention. A detailed description of conventional tubes is to be found for example in "Revue Technique Thomson-CSF", volume 3, number 4 December 1971, pages 695 to 725, in an article entitled "Storage tubes".

Figure 1:
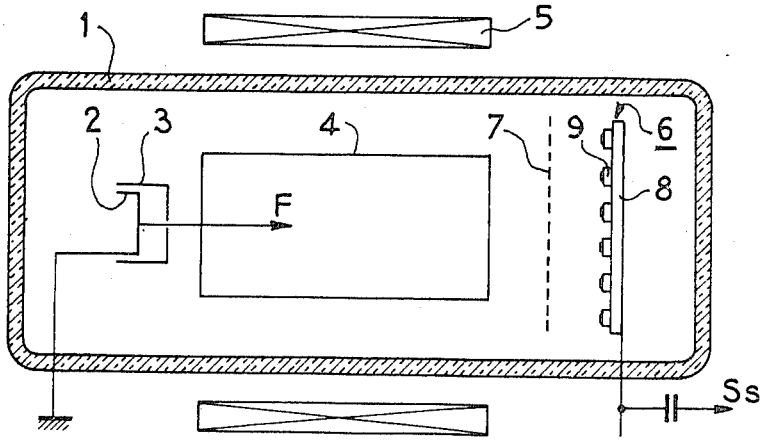
FIG. 1 is a schematic, sectional view, of the important parts of a storage tube in accordance with the invention.

A tube in accordance with the invention comprises, inside a sealed, evacuated enclosure 1, an electron-gun schematically illustrated in FIG. 1 by its cathode 2, its beam-intensity control electrode or Wehnelt electrode 3, and a block 4 symbolising the various conventional accelerating and concentrating electrodes. Deflection means symbolized in the example by coils 5, make it possible to deflect the electron beam F emitted by the gun and cause it to scan a storage target 6. Electrostatic means may also be used for this purpose in embodiments of the invention. An electrode generally referred to as the field grid 7 is arranged in front of the storage target in the path of the beam F and, again in a conventional way, picks up the electrons bouncing back from or emitted by the target 6.

The originality of the tube in accordance with the invention resides in the storage target 6 which has a novel structure, and in the use made of this novel structure in order to achieve accurate addressing both at the time of recording and at the time of read-out of information sequences.

Figure 2:
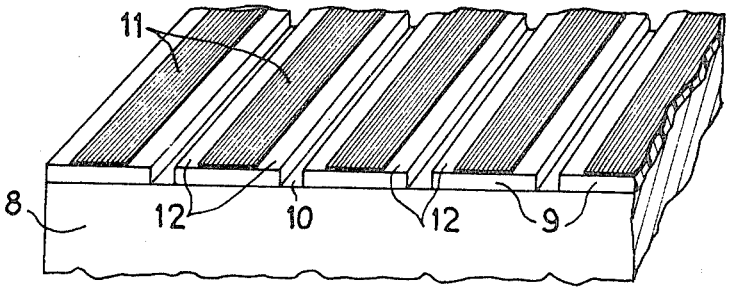
FIG. 2 is a schematic perspective view of part of the storage target of a tube in accordance with the invention.

The structure of the storage target 6 will be more clearly understood on FIG. 2 which illustrates a part of it in perspective.

It comprises a conductive plate 8 made of metal for example. On said conductive plate 8 bands 9 of dielectric material are deposited; these bands are parallel and are spaced slightly apart from one another in order to expose fine metal bands 10 on the plate 8. This structure, up to that point, is a classical one for a storage tube, informations being recorded and stored on the dielectric bands.

In a tube target in accordance with the invention, the dielectric bands 9 are covered over part of their surface by conductive bands 11, for example of metal; these conductive bands 11 are narrower than the dielectric bands 9 in order to expose a dielectric band 12 at either side of a conductive band 11. The assembly of a metal band 10 on the plate 8 and the two exposed dielectric bands 12 surrounding it, constitutes a recording track along which there may be sequentially recorded, in a manner now to be explained, the informations forming a sequential message.

The operations of recording, read-out and erasing, that is to say the method by which the electrical charges are deposited, then read out and removed from the dielectric zones exposed to the beam, can be performed by one or the other of two conventional techniques, well known in themselves and encountered in conventional storage tubes. The first and indeed the more frequently used technique consists operating recording with the help of a highly accelerated beam F, the plate of the target and the field grid being placed at a sufficiently positive potential in relation to the cathode to ensure that the beam, in the dielectric zones which it strikes, produces secondary electron emission with a coefficient $\delta$ greater than unity. The information to be recorded modulates the beam current, for example in on-off fashion in the case of binary information, through the medium of a control signal applied to the modulating or Wehnelt electrode. Positive charges are thus deposited upon the dielectric, which represent informations to be stored. Non-destructive read-out is performed by a beam of slow electrons, that is to say electrons which are not highly accelerated, which are repulsed to a greater or lesser extent by the various zones of the target as a function of the informations that has been recorded there. The video signal is picked off from the plate of the storage target. As far as erasing is concerned, this is performed by scanning the target with slow electrons which place the potential of the dielectric at the cathode potential, that is to say place it in "equilibrium". However, this technique is not the best n the case of a tube in accordance with the invention which will advantageously utilise the second technique; ne first technique has been mentioned here simply ecause, although not yielding the best possible results, may sometimes be relevant to use it.

The second technique, which in the present instance ears attractive for reasons which will be specified at ter point in this description, consists in recording ces of information in a manner analogous to the to the beam once directed the chosen track; this information will be set out later on.

Figure 3:
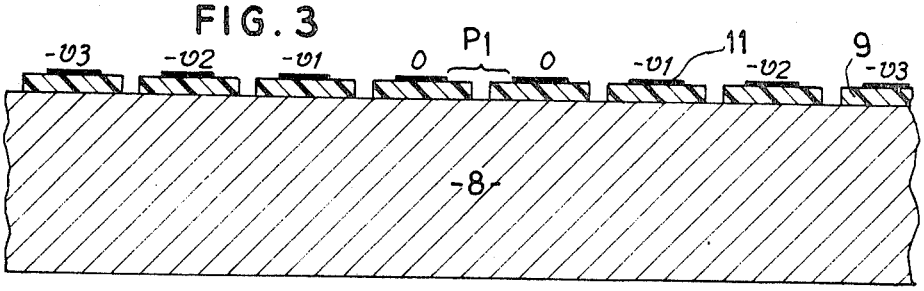
FIG. 3 is a sectional view of part of an addressed target.
Figure 4:
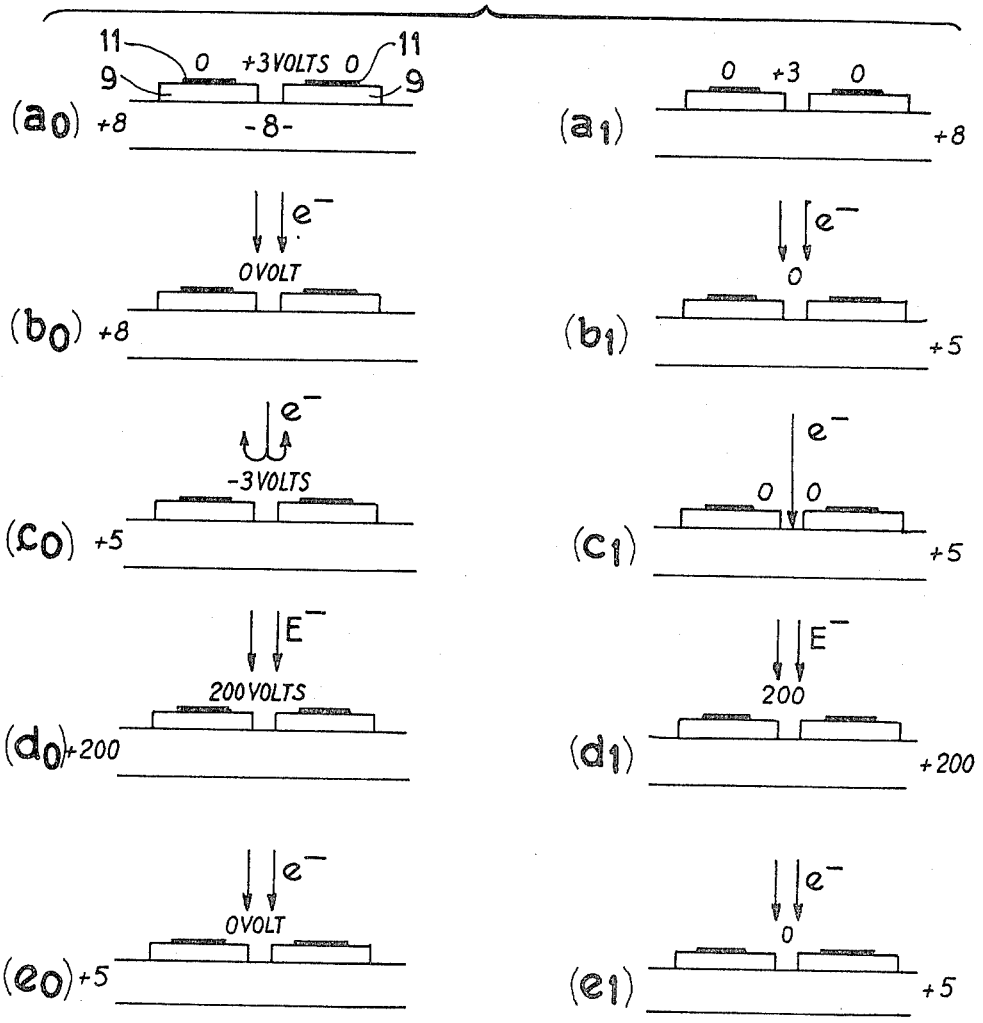
FIG. 4 illustrates sectional views of an addressed track $P_1$, during phases of recording, read-out and erasing.

In accordance with the invention, the electrons beam F emitted by the cathode 2 of the electron-gun is sufficiently thick to direct its electrons simultaneously towards several tracks and for example towards the seven tracks illustrated in FIG. 3. To produce a beam of this kind it is possible either to confine ourselves to a thick cylindrical beam, this having the drawback of not recording very much information along each track, or to process a thin beam in such a fashion that its trace on the target is long in the direction perpendicular to the tracks and very fine in the direction along the tracks. This can be achieved either by using a beam which is fine in all directions and subjecting it to micro-scanning in the direction perpendicular to the tracks, or by using a highly astigmatic beam.

The second solution is perferable to the first. Not only can it be achieved very simply using a quite conventional electron-optical system, but it also makes it possible to achieve a finer spot considered in the direction of the tracks, and to store more information. An example of the conventional dimensions of the section of an astigmatic beam is: 200 microns long and 10 microns wide.

This kind of astigmatic beam being for example directed towards the seven tracks shown in FIG. 3, it now has to be arranged that the electrons strike only one of the seven tracks, for example that $P_1$. The plate 8 and the field grid 7 are placed at a positive potential in relation to the cathode and the conductive bands 11 surrounding the track $P_1$ which has been do ased by diffe ed by diffe The left-hand column, rows ($a_o$) to ($e_o$), corresponds to the recording of the state which we will define for example as being the binary state "0", whilst the right-hand column, rows ($a_1$) to ($e_1$), corresponds to the other state, binary "1" in this case. The different elements 8, 9 and 11 have not been cross hatched, even though viewed in section, simply in order not to overburden the figure.

The first row indicates that in the initial state, after the target has been prepared —row (e)— the dielectric areas exposed to the beam are at a potential (+ 3 volts) less by 5 volts than that (+ 8 volts) of the plate 8.

The recording ($b_o$) of a "0" is performed by sending towards the target a beam of slow electrons $e^-$ and by placing the potential of the plate 8 at + 8 volts; the potential on the dielectric is brought down to the cathode potential, 0 volts; it drops by 3 volts. The recording ($b_1$) of a "1" is performed by bombardment with slow electrons $e^-$ and by placing the plate at + 5 volts; the potential on the dielectric, already 5 volts less than that on the plate at ($a_1$), remains unchanged.

Read-out, rows ($c_o$) and ($c_1$), is performed by placing the plate at 5 volts. If a "0" is recorded the slow electrons $e^-$ are repulsed and captured by the field grid so that no signal is picked off from the plate which furniches the output signal $S_r$. If a "1" is recorded the slow electrons of the read-out beam strike the visible part of the plate and an output signal is picked off.

Erasing, rows ($d_o$) and ($d_1$), effected by placing the plate at a high potential, for example + 200 volts; the fast electrons $E^-$ place the dielectric at the potential + 200 volts (the field grid likewise being placed at this same potential, in a conventional way).

The system is finally prepared, rows ($e_o$) and ($e_1$), by raising the plate to + 5 volts and scanning the tracks with slow electrons which bring the dielectric to 0 volts, creating a potential difference of 5 volts between dielectric and plate.

Figure 5:
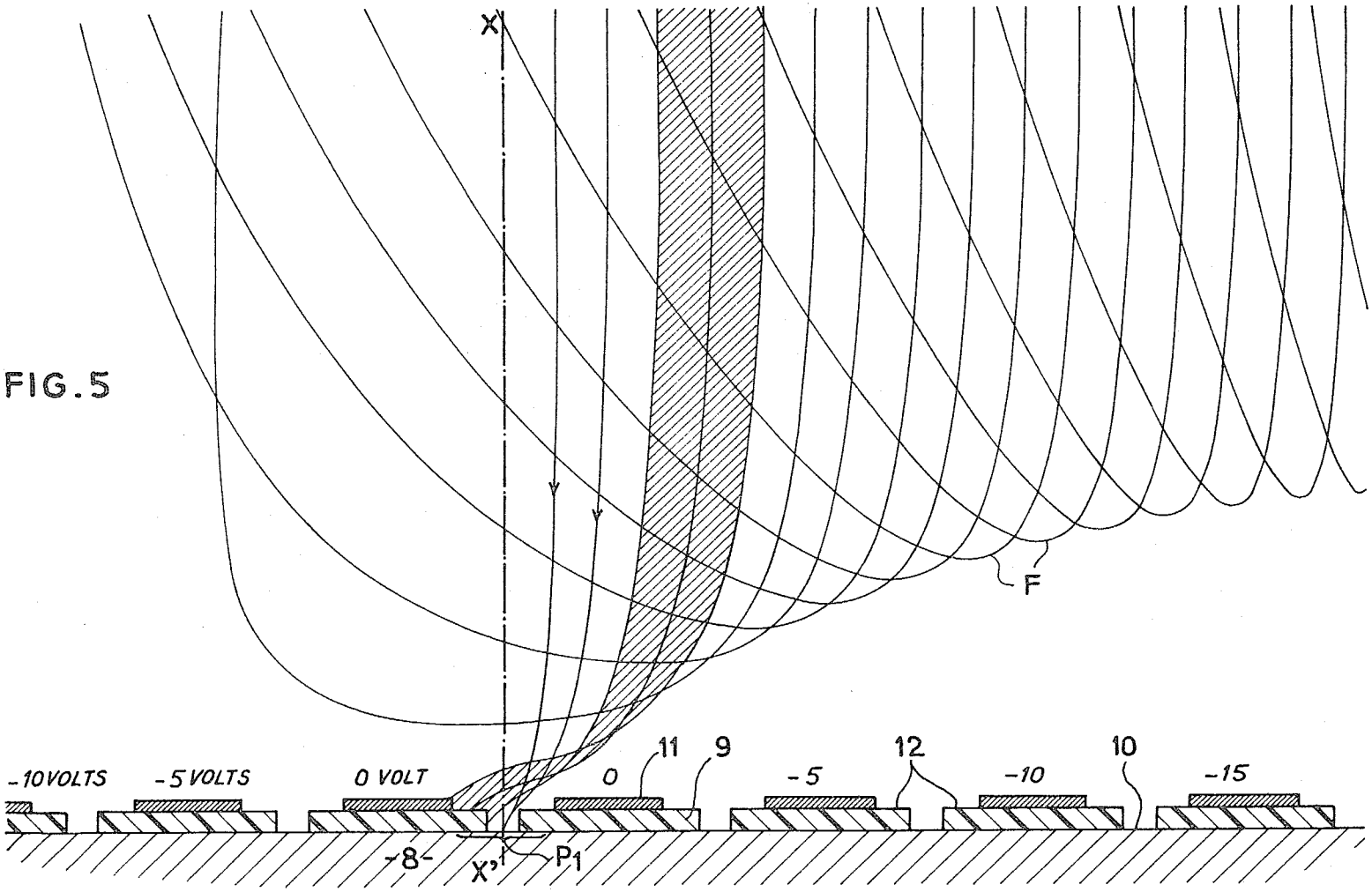
FIGS. 5, 6 and 7 represent electron trajectories when recording on a track $P_1$ and when reading a "1" and a "0" on said track.

FIG. 5 illustrates the shape of the trajectories of the electrons $e^-$ of the astigmatic (or wobbulated) beam F, towards an addressed track $P_1$, for the recording situation. Only half the trajectories have actually been shown, simply in order not to overburden the figure; the other half of the trajectories are symmetrical in relation to the axis XX' passing through the centre of the addressed track $P_1$. The cross-hatched part illustrates the effective fraction of the beam.

Figure 6:
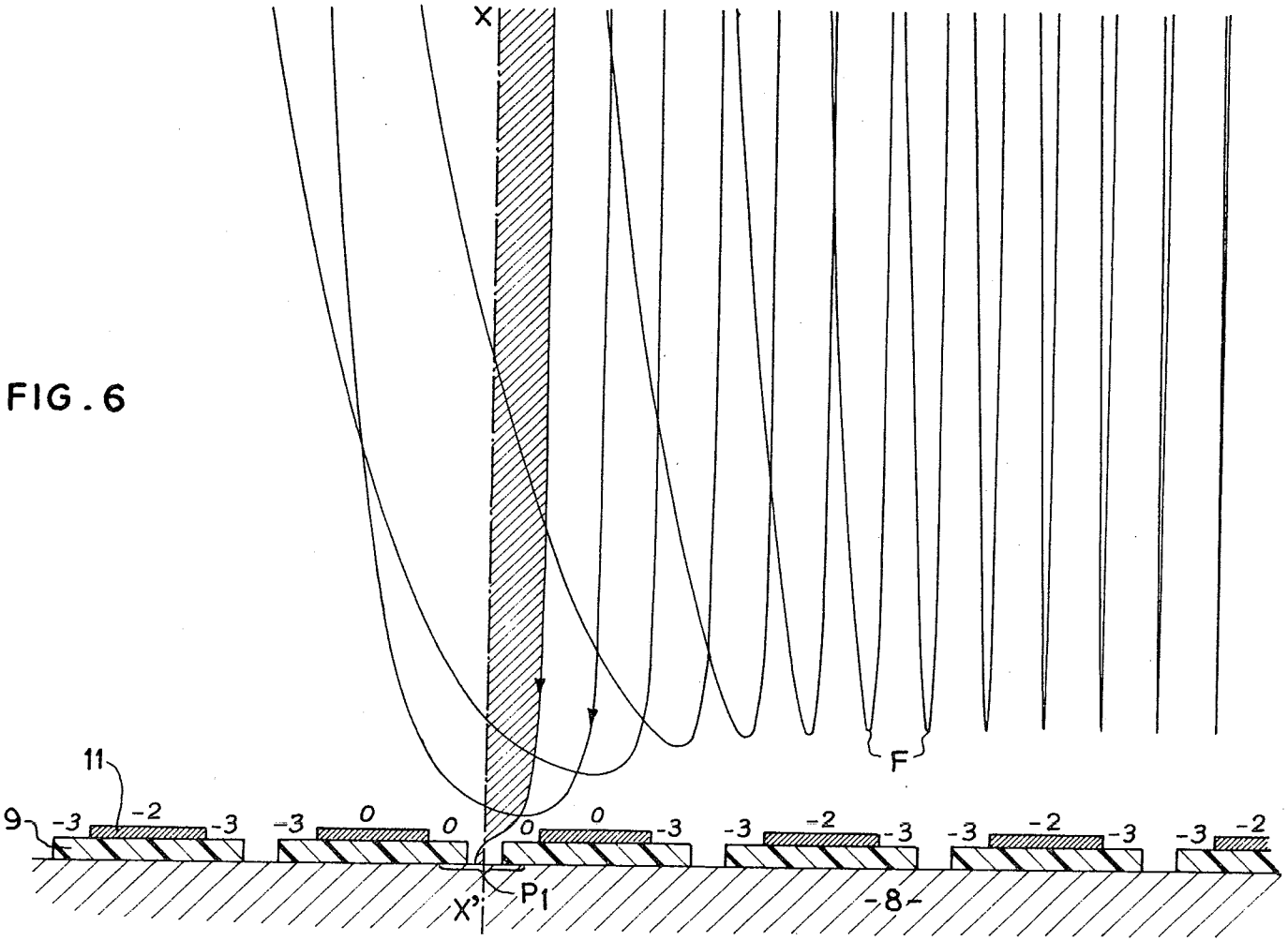
Figure 7:
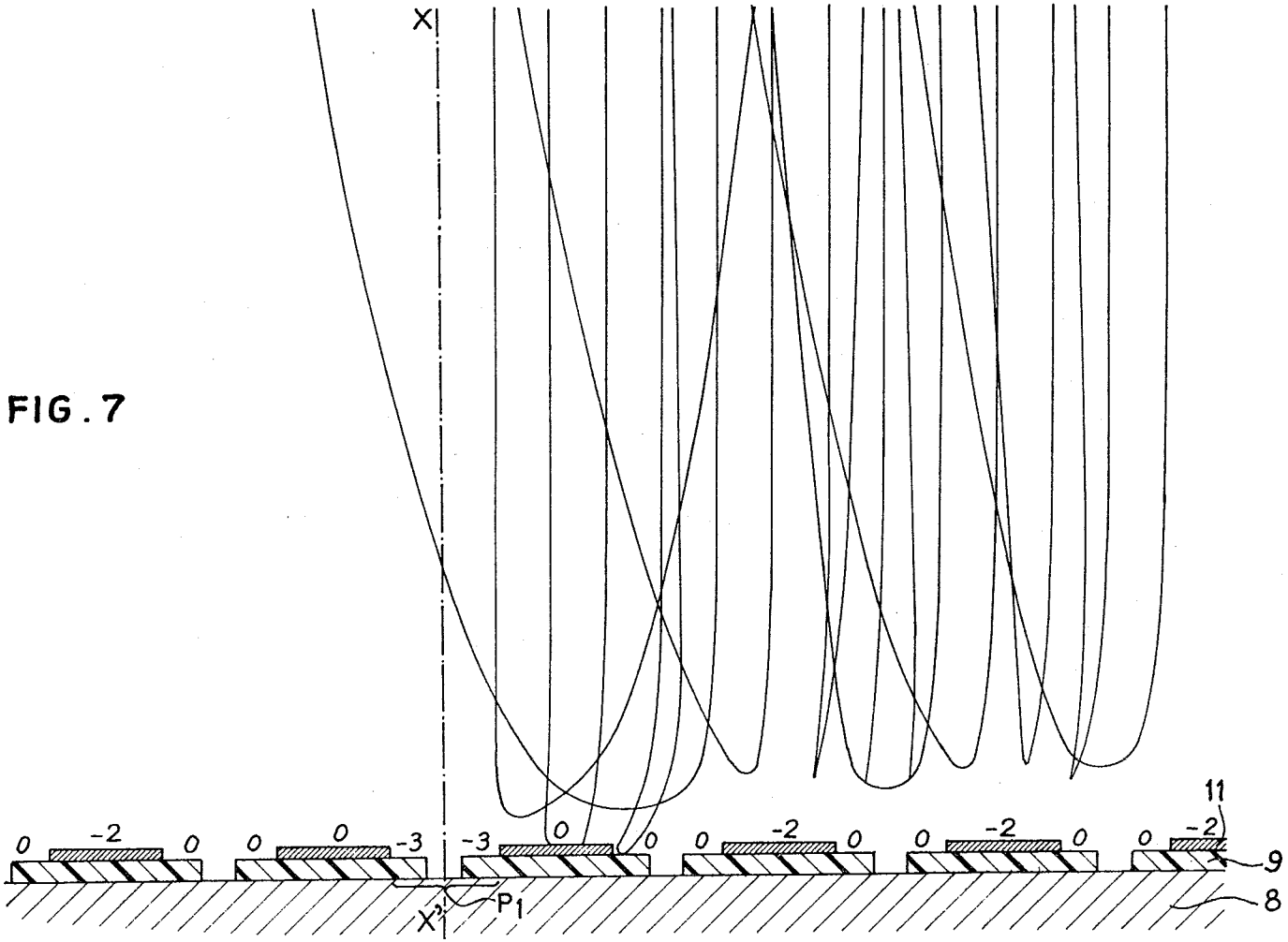

FIGS. 6 and 7 illustrate the trajectories of the electrons $e^-$ of the beam F at the time of read-out of a point from an addressed track $P_1$, corresponding respectively to between "1" and "0".

The numerals indicated above the conductive bands 11 and the exposed parts 9 of the dielectric areas, are the potentials on these surfaces. It will be observed that the negative addressing potentials for the read-out function are slightly lower in absolute value than the addressing potentials used at the time of recording. These figures have been chosen to give proper read-out in the extreame cases, illustrated here, namely the situation in which a "1" is surrounded by "0" at either side (FIG. 6); and "0" is surrounded by a "1" at either side (FIG. 7); these are only examples however.

The convention adopted here for the states "1" and "0" makes it possible to pick off a signal at the time of read-out of a "1" and no signal at the time of read out of a "0" ; however, the contrary convention may be preferred, this involving the deposition of electrons on the target when the recording of a "1" takes place, and the non-deposition of electrons there at the time of the recording of "0".

It should be pointed out, furthermore, that to the extent to which the message recorded sequentially along the tracks, one track after another, is to be read out once only, it is possible to resort to destructive read-out. To do this, it is merely necessary to place the track and the conductive bands (FIG. 5) at the same potentials used at the time of recording of a "0", that is to say to place the plate at the potential + 8 volts and to scan the track selected in this way, with slow electrons $e^-$. At the locations where a "0" has been recorded, these locations already being in the equilibrium state, no current will flow through the plate; at the location where a "1" has been recorded, the dielectric will have been returned by the beam to the equilibrium potential and will give rise to a signal. After this kind of read-out, the message is erased.

The biasing of the conductive bands 9 which make it possible to effect addressing of the tracks, both at recording and read-out, can be performed in different ways. It can be carried out by individual biasing of the conductive bands which are each connected to an individual output accessible at the exterior of the tube, the bias voltages being switched to these outputs by conventional means. Again, it can be performed by the simultaneous biasing of groups of electrodes. Instead of all being insulated from one another, the $n^{th}$ conductive bands are connected together. For example, the bands of order 1, 11, 21, 31 etcetera are connected together and likewise the bands of order 2, 12, 22, 32 etcetera, each of these groups being connected to an independent external output. It is then merely necessary to switch the bias voltages between these outputs. In this way, the number of outputs is divided by $n$ (10 in the given example). This, of course, assumes that the inaccuracy of addressing does not exceed $n$ times the width between two conductive addressing bands. The choice of $n$ will be made as a function of this inaccuracy.

Figure 8:
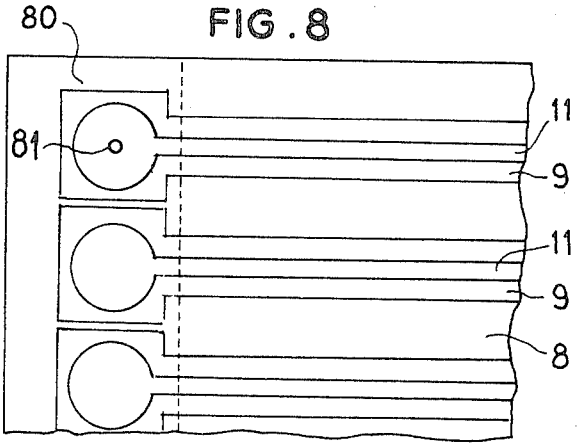
FIG. 8 is a schematic view of part of a target in accordance with the invention.

Another method of biasing, which can also be performed electrode by electrode or per group of $n$ electrodes, consists in utilising the electron beam of the tube in order to place each band or group of bands at the desired potential. In effect, each band or group of bands, being insulated, can have its potential modified, by bombarding it with fast electrons, through the emission of secondary electrons. It is merely necessary to bombard one end of each band since they are conductive and equipotential in state; this bombardment will be carried out at an unused part of the target, located around the effective part which latter will not therefore experience any disturbance in its charge state, the latter representing the recording information. FIG. 8 schematically illustrates an arrangement of conductive bands 11 which makes it possible, at the unused area 80 of the target, to effect biasing by means of an electron beam the spot of which has been shown at 81.

What is claimed is:

1. In a storage tube for the storage of sequences of digital informations comprising an electron-gun, a storage target and means for deflecting the electron-beam emitted by said electron-gun towards said target so that its impact area scans said target, the improvement consisting in the following characteristics:

said storage target is made of dielectric bands on a conductive plate, said dielectric bands being partly covered by conductive bands narrower than said dielectric bands;

said electron-gun emits a beam which is so thick in at least one direction of its cross-section, namely that direction perpendicular to said dielectric bands of said target, that it emits electrons simultaneously towards a plurality of neighbouring dielectric bands;

biasing means are provided for biasing said conductive bands so that said bands are biased, as when recording informations as well as when reading them out, in such a way that the electrons emitted by said electron-gun towards a plurality of neighbouring dielectric bands only strike one zone between two conductive bands of said plurality, each such zone between two neighbouring conductive bands being called a track.

2. A tube as claimed in claim 1, wherein the recording and then the read-out, of a sequential digital message is performed along each track, said deflection means for the beam (F) causing the latter to be deflected parallel to said tracks.

3. A tube as claimed in claim 2, wherein the addressing of a predetermined track ($P_1$) is performed by biasing conductive bands surrounding it, with potentials ($-v_1$, $-v_2$, $-v_3$) which are progressively more and more negative as one works away from said track, so that the electrons of the beam (F) are only accepted between the two conductive bands closes to said track ($P_1$).

4. A tube as claimed in claim 3, wherein the two conductive bands surrounding said addressed track ($P_1$) are placed at the reference potential of the cathode of the tube electron-gun.

5. A tube as claimed in claim 1, wherein said conductive bands are individually connected to external outputs of the tube, which are themselves connected to said biasing means for applying to said conductive bands the addressing bias voltages.

6. A tube as calimed in claim 1, wherein said conductive bands are connected to one another *n* to *n*, the thus connected groups of bands themselves being connected to external outputs of the tube which are themselves connected to said biasing means for applying to said conductive bands the addressing bias voltages.

7. A tube as claimed in claim 1, wherein said conductive bands are extended, at an unused area of the target, in the form of metal zones on to which the electron beam of the tube is directed, the beam, by knocking out secondary electrons, biasing said bands in turn in turn order to perform addressing.

8. A tube as claimed claim 7, wherein the said conductive bands are connected together *n* to *n;* and wherein said beam sequentially biases each of the groups thus formed.

9. A tube as claimed in claim 1 wherein the recording of information on the target is performed "in equilibrium", the recording beam being a beam of slow electrons.

* * * * *